US007534358B2

(12) United States Patent
Whisler et al.

(10) Patent No.: US 7,534,358 B2
(45) Date of Patent: May 19, 2009

(54) HORIZONTAL VIBRATORY CENTRIFUGE APPARATUS

(75) Inventors: Kevin R. Whisler, St. Louis, MO (US); Christopher A. Bertocchini, O'Fallon, MO (US)

(73) Assignee: Elgin National Industries, Inc.

( * ) Notice: Subject to any disclaimer, the term of this patent is extended or adjusted under 35 U.S.C. 154(b) by 243 days.

(21) Appl. No.: 11/385,236

(22) Filed: Mar. 20, 2006

(65) Prior Publication Data

US 2007/0215560 A1 Sep. 20, 2007

(51) Int. Cl.
*B04B 3/06* (2006.01)

(52) U.S. Cl. ..... 210/781; 210/785; 210/360.1; 210/370; 210/380.1; 210/380.3; 210/384; 210/388

(58) Field of Classification Search ..... 210/360.1, 210/370, 380.1, 380.3, 384, 388, 781, 785
See application file for complete search history.

(56) References Cited

U.S. PATENT DOCUMENTS

| | | | | |
|---|---|---|---|---|
| 2,204,007 | A | 6/1940 | Baily | |
| 2,556,317 | A | 6/1951 | Cook | |
| 2,626,745 | A | 1/1953 | Fletcher, Jr. | |
| 3,133,879 | A | 5/1964 | Becker | |
| 3,636,468 | A * | 1/1972 | Ellis | 210/363 |
| 4,079,882 | A | 3/1978 | Mizuyoshi et al. | |
| 4,253,961 | A | 3/1981 | Schlebusch et al. | |
| 4,639,320 | A | 1/1987 | Smith | |
| 5,127,512 | A | 7/1992 | Frolich et al. | |
| 5,616,245 | A * | 4/1997 | Albrecht | 210/380.1 |
| 5,676,835 | A | 10/1997 | Derton et al. | |
| 5,780,780 | A | 7/1998 | Ahmed | |
| 6,260,391 | B1 | 7/2001 | Rippe | |
| 2002/0086789 | A1 | 7/2002 | Carson et al. | |

FOREIGN PATENT DOCUMENTS

WO WO 2007109603 A2 * 9/2007

OTHER PUBLICATIONS

CMI Model MPC 2005.

* cited by examiner

*Primary Examiner*—David A Reifsnyder
(74) *Attorney, Agent, or Firm*—Garvey, Smith, Nehrbass & North, L.L.C.; Gregory C. Smith

(57) ABSTRACT

A horizontal vibratory centrifuge, which includes a slurry separating component; a drive motor; a drive unit for rotating the separating component; a feed pipe for feeding the slurry into the separating component; a product discharge for discharging the solid portion of the slurry from the separating component and a pipe for discharging the fluid portion from the separating component; at least one vibratory motor mounted onto the drive unit; a plurality of connecting rods moveably connecting the drive unit to a torsion bar assembly, the assembly including a plurality of torsion bars, each mounted on a first end to an upper fixed spring clamp and a lower fixed spring clamp, and on a second end to the connecting rods with bearings, so that the vibrations of the low energy vibrating motor is in resonance with the springs so as to provide in part maximum vibration to the vibrating assembly at low energy levels. There is also provided the method of imparting vibration to a slurry in the separation component by a single low energy vibrating motor which operates in resonance with the torsion springs to achieve maximum vibration and thus maximum separation between the solid and liquid components of the slurry.

23 Claims, 5 Drawing Sheets

HORIZONTAL VIBRATORY CENTRIFUGE APPARATUS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to vibratory centrifuges. More particularly, the present invention relates to an improved vibratory centrifuge which provides maximum vibration of the centrifuge through the natural resonance between a single vibratory motor and torsion springs upon which the system is mounted.

2. General Background of the Invention

Centrifugal separators or centrifuges such as horizontal centrifuges are generally used for the separation or the removal of liquid from solids such as coal or other types of solids. The vibratory centrifuge is usually defined as a low G machine that conveys solids over a screen surface with oscillating or vibratory motion. The machine is best suited for a range of particle sizes and both have inherent advantages and disadvantages. Normally, there is a thick bed that is maintained on the screen surface, there is not much loss of solids through the screen openings. This is advantageous in that the vibratory unit is a higher recovery device and thus more efficient machine. However, the thick bed also reduces the drying or dewatering that occurs. Thus, the current vibratory machines provide high recovery efficiencies but will not remove as much water or liquids as will the screen-scrow machines.

Currently, most vibratory centrifuges use what is termed "brute force", that is operating in sub-resonance, to impart vibration to the vibrating component. Such a device is very costly and inefficient. Therefore, there is a need in the industry for a horizontal vibratory centrifuge, which can utilize a link between the vibrating motor and the vibrating component through an indirect link, rather than through the brute force of the direct link concept. Such a device is the subject of this patent application.

BRIEF SUMMARY OF THE INVENTION

The apparatus of the present invention solves the shortcomings of the art in a simple and straightforward manner. What is provided is a horizontal vibratory centrifuge, which includes a slurry separating component; a drive motor; a drive unit for rotating the separating component; a feed pipe for feeding the slurry into the separating component; a product discharge for discharging the solid portion of the slurry from the separating component and a pipe for discharging the fluid portion from the separating component; at least one vibratory motor mounted onto the drive unit; a plurality of connecting rods moveably connecting the drive unit to a torsion bar assembly, the assembly including a plurality of torsion bars, each mounted on a first end to an upper fixed spring clamp and a lower fixed spring clamp, and on a second end to the connecting rods with a pillow bearing, so that the vibrations of the low energy vibrating motor is in resonance with the springs so as to provide in part maximum vibration to the vibrating assembly at low energy levels.

There is also provided the method of imparting vibration to a slurry in the separation component by a single low energy vibrating motor which operates in resonance with the torsion springs to achieve maximum vibration and thus maximum separation between the solid and liquid components of the slurry.

Therefore it is a principal object of the present invention to provide an improved horizontal vibrating centrifuge, which imparts maximum vibration to the vibrating centrifuge component through the use of a single low energy motor mounted with the assembly;

It is a further object of the present invention to provide a horizontal vibrating centrifuge which includes a vibrating motor mounted upon a torsion bar spring assembly so that the vibration of the motor is in resonance with the torsion bars to effect the maximum vibratory motion to the vibrating component of the system;

It is a further object of the present invention to provide a simplified horizontal vibrating centrifuge which eliminates the brute force or sub-resonance and replaces it with at least one low energy vibrating motor which operates in resonance with springs for effecting the maximum vibratory motion to the vibrating system;

It is a further object of the present invention to provide a horizontal vibrating centrifuge which includes a drive unit mounted on torsion bars, the torsion bars connected to upright members, which mount to axle shafts in the assembly to impart vibration to the vibrating component.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
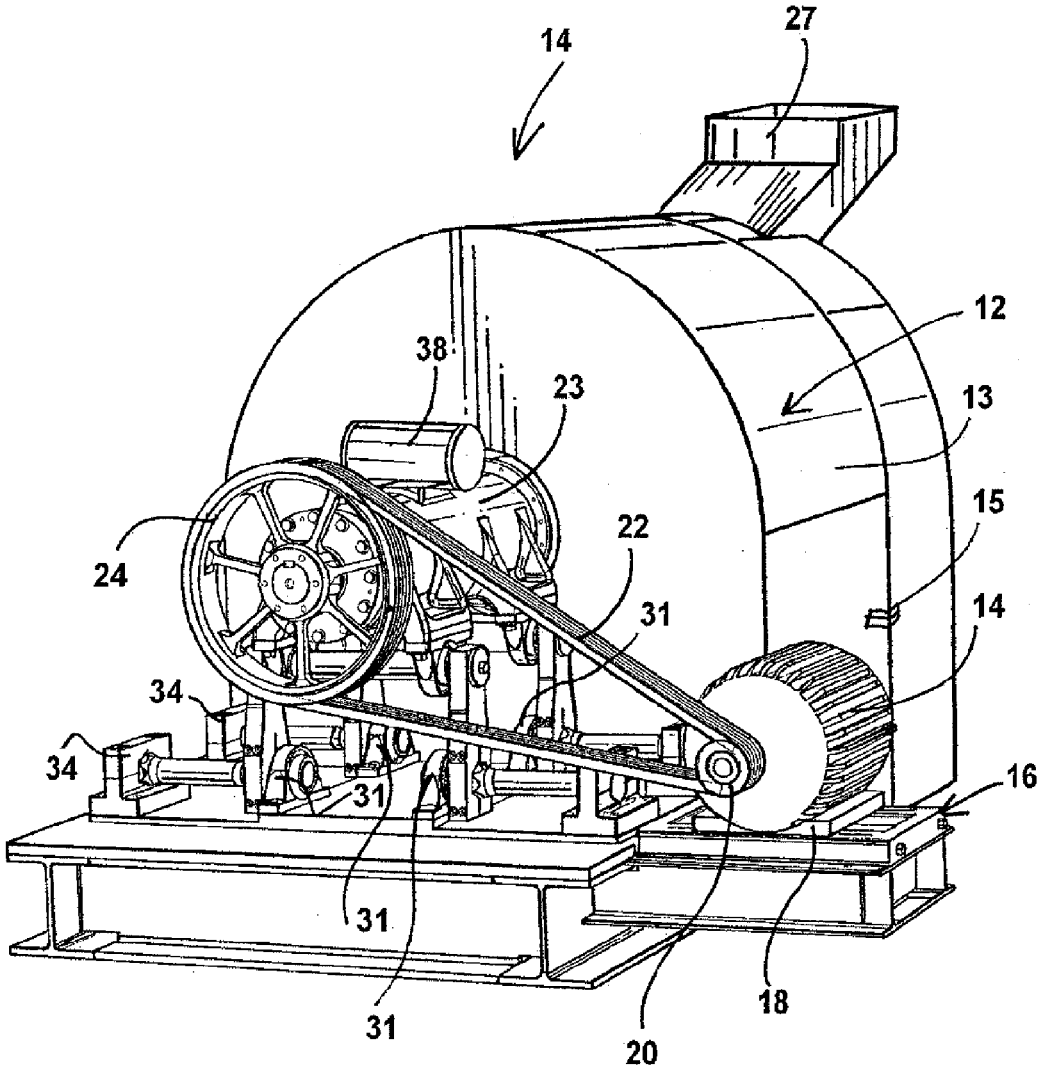
FIG. 1 illustrates an overall view of the preferred embodiment of the horizontal vibrating centrifuge of the present invention.
Figure 2:
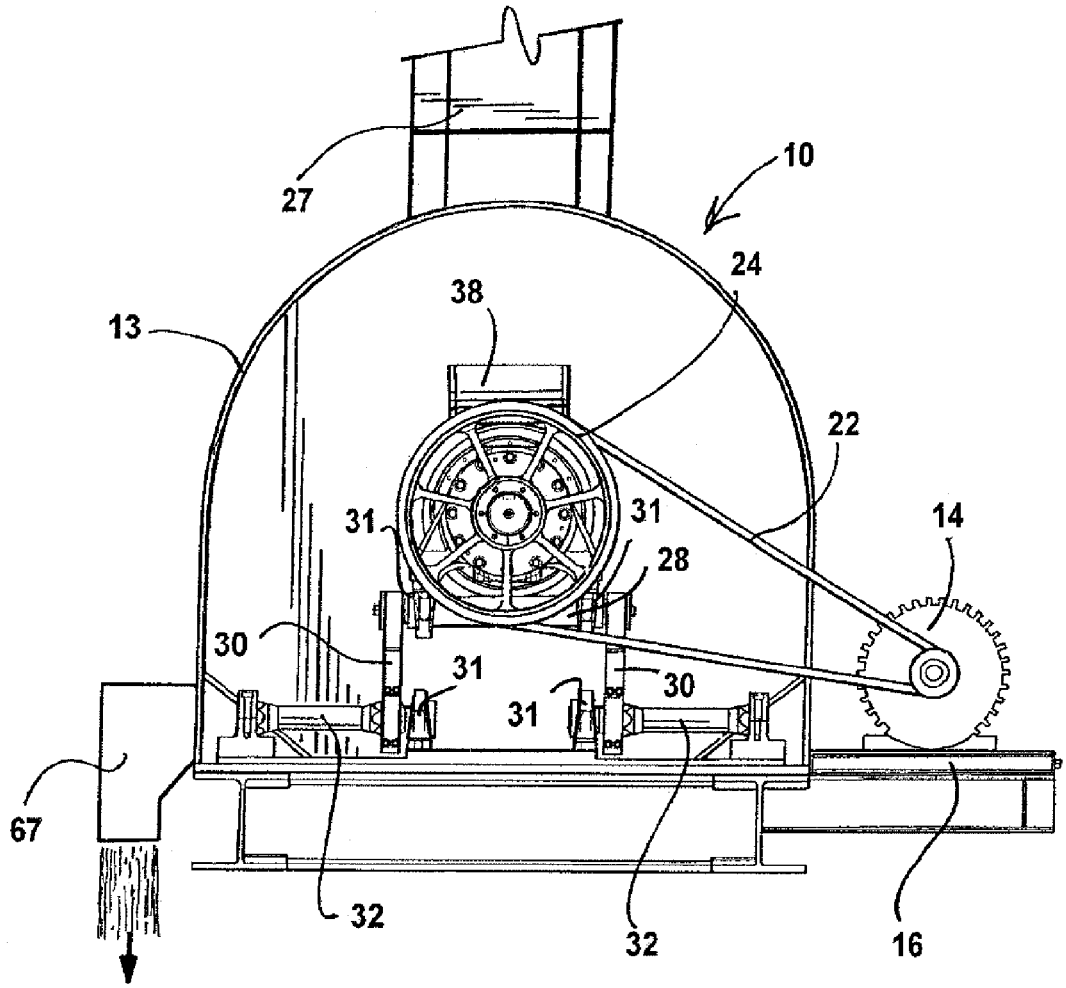
FIG. 2 illustrates a front view of the preferred embodiment of the apparatus of the present invention.

FIGS. 1-5 illustrate the preferred embodiment of the apparatus of the present invention by the numeral 10. As illustrated in the Figures, there is illustrated horizontal vibrating centrifuge apparatus 10 which includes a slurry separation component 12 having a circular outer wall 13, with a door latch 15, for having access to the rotating screen or basket 50 within the interior 51 of the separation component 12, through a rear wall 29. As seen in FIGS. 1 and 2, apparatus 10 includes an electrical drive motor 14, positioned on an adjustable motor base 16, held in position by motor mount 18. Drive motor 14 includes a drive motor sheave 20 through which a drive belt 22 is mounted to the drive assembly 23, upon which there is mounted a drive unit sheave 24 for accommodating the belt 22. Rotation of the belt 22 imparts rotation to the drive assembly 23 and ultimately the basket or rotating screen 50 within the interior 51 of the separation component 12. It should be noted that there may or may not be a basket within the interior 51; that is, the screen 50 may be mounted therein without the use of a basket per se; therefore screen 50 will be referenced. For purposes of operational components, although the preferred embodiment links the motor 14 to the drive assembly 23 with a belt 22, it is foreseen that the connection may be through other means, such as, for example, a direct drive link between the motor 14 and drive assembly 23.

Figure 4:
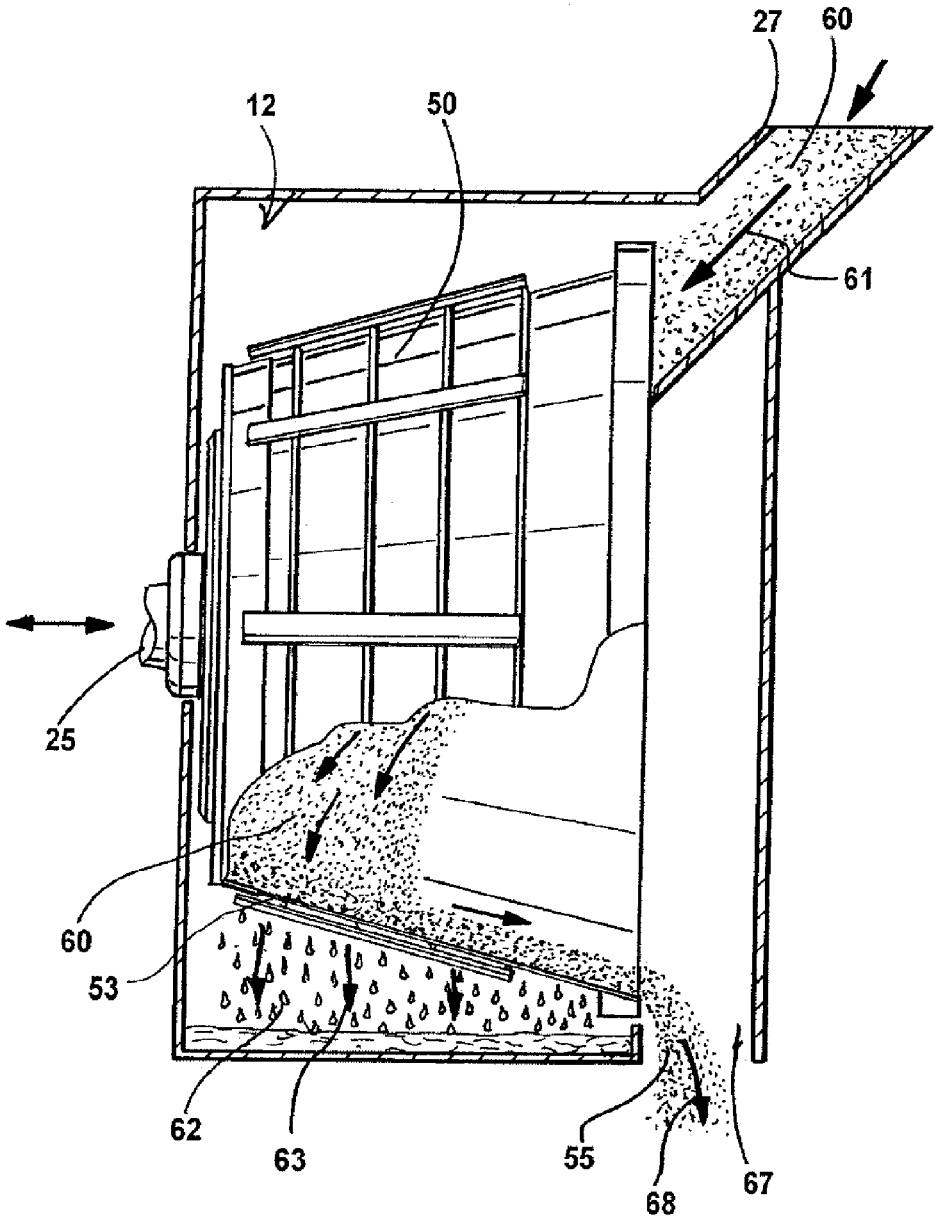
FIG. 4 illustrates a cutaway view of the separation component of the apparatus of the present invention wherein slurry is being moved through the vibrating component.

As seen in the Figures, there is included in the cutaway view a feed pipe 27 into which slurry 60 is fed as seen by arrow 61. For purposes of clarity, the term "slurry" may be defined as a mixture of a liquid and insoluble solid material. There is provided a back wall 29, which of course would mate with circular wall 13 to define the interior 51 of the separation component 12. There is provided a rotating screen 50 which would rotate when the motor rotates the drive assembly 23 during the separation process. As seen in the Figure, slurry 60 is fed into feed pipe 27. The slurry 60 may comprise, for example, a coal slurry, having both solid and liquid components, or the like. As the slurry 60 enters into the rotating screen 50, the slurry is rotated and vibrated in a manner as will be discussed further, so that the fluid portion 62 is filtered through the screen 50, and the solid portion 55 exits the product discharge chute 67, as seen by arrow 68. The chute 67 would discharge the solid portion 55 of the slurry, and the discharge pipe 25 would discharge the fluid or effluent portion 62, such as water, as seen in FIG. 4 by arrows 63. The screen 50 would usually be coated with a moist cake of filter material from the slurry to assist in the recovery of the solid materials.

Turning now to the specifics of the means in which the improved vibratory centrifuge 10 is operated, reference is made to the Figures where the drive assembly 23 is mounted on an axle shaft 28. At both ends of the axle shaft 28 there is provided a plurality of vertically inclined connecting rods 30. At the connection between the axle shaft 28 and the connecting rods 30, there is provided bearing assembly, housing bearings 31, so that movement is allowed between the shaft 28 and the connecting rod 30 during operation. Each of the connecting rods 30 would be moveably connected to an end of a horizontally positioned torsion bar or torsion spring 32. Each torsion bar 32 is mounted on a first fixed end 33 by an upper fixed spring clamp 34 and a lower fixed spring clamp 36, and are movably or flexibly mounted on their second end 35 to the lower end 41 of each of the connecting rods 30 via a bearings 31. In the preferred embodiment, bearings 31 would be pillow block mounted roller bearings for optimal performance.

Figure 5:
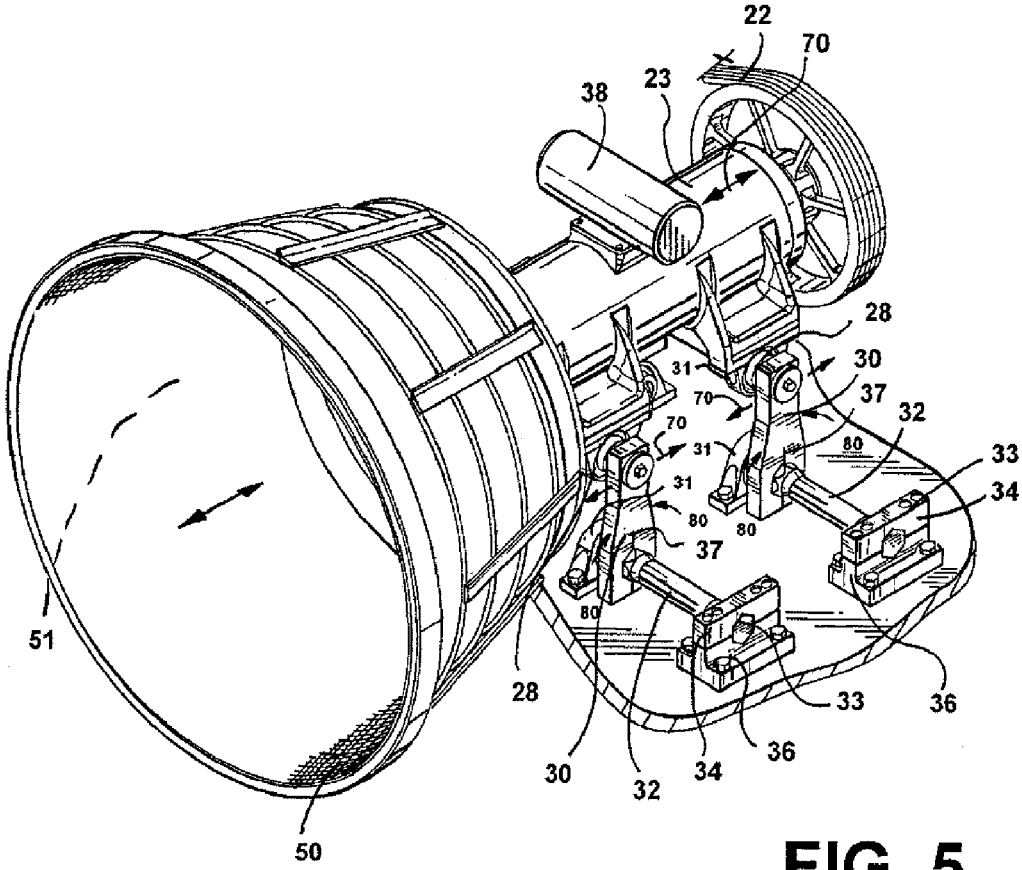
FIG. 5 illustrates a rear view of the apparatus of the present invention showing the vibrating screen component.

This connection is illustrated in FIG. 5, which illustrates the axle shafts 28 upon which the drive assembly 23 is mounted, directly linked to the upper end 43 of each of the vertically inclined connecting rods 30 in bearings 31. The lower ends of each of the connecting rods 30 are mounted to the second ends 35 of the torsion bars 32, at bearings 31. The first end of the torsion bars 32 in turn mounted on their first ends to the upper fixed spring clamp 34 and lower fixed spring clamp 36. It is important to note in FIG. 5 that the lower end 41 of each connecting rod 30 is divided into a first portion 45 and second portion 47, with a space 49 formed between the two ends 45, 47, including a means to engage ends 45 and 47 to one another. The two portions 45, 47 of connecting rods 30 provide a means for the upright rods 30 to move in the direction of arrows 80 during the separation process. It is foreseen that the means to engage portions 45, 47 may be welding or other type of attachment members, such as bolts, screws or the like.

As an alternative embodiment, in the assembly illustrated in FIG. 5, the drive assembly 23 could be mounted on torsion bars 32, rather than axle shafts 28, and the lower ends of the connecting rods 30 could be mounted to the second ends of axle shafts 28, rather than torsion bars 32, and the same operational integrity of the system could be achieved. Simply stated, the axles 28 and torsion bars 32 could be interchanged in the system and achieve the same results.

Figure 3:
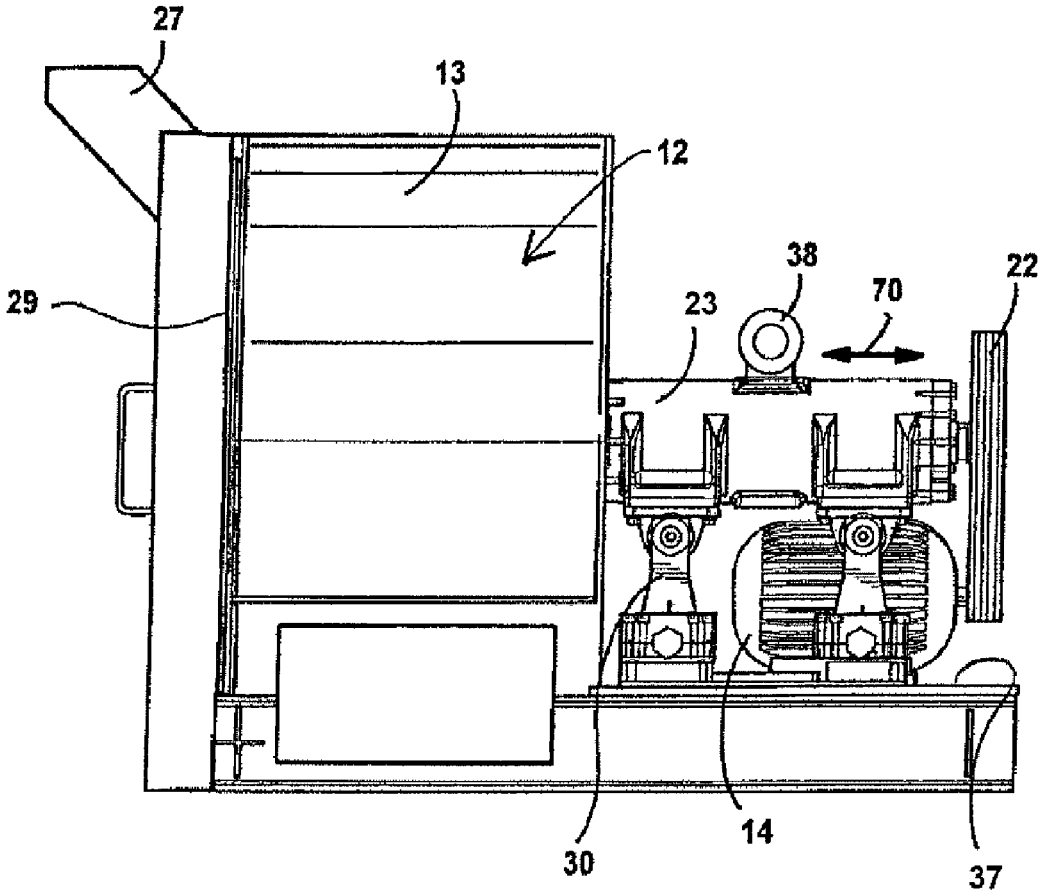
FIG. 3 illustrates a side view thereof.

Therefore, as seen in FIG. 3, when vibratory motor 38 imparts vibration of the drive assembly 23, mounted on mounting platform 37 in the direction of arrows 70, the vertically inclined connecting rods 30 move in the direction of arrows 80, as seen in FIG. 3, and in doing so, the mounting of the lower ends 41 of the rods with bearings 31 result in a vibratory movement in unison with the resonance of the torsion bars 32, which imparts the maximum vibratory motion to the separation component 12. For purposes of clarity, "resonance" or "in resonance" is defined as the input frequency within ±20% of a resonant frequency of the suspension (fundamental frequency or multiple thereof.)

In the preferred embodiment, there is provided a single vibratory motor 38 attached to and mounted on the drive unit 23 as seen in FIG. 2. The vibratory motor would preferably be a low energy motor. Although a single vibratory motor 38 is preferred, it is foreseen that there may be required multiple vibratory motors 38. The vibrator motor that will be used is more preferably termed an "electric eccentric-weight motor," in the preferred embodiment. However, other types of devices could be employed to produce the input force for the vibratory motion: pneumatic vibrators, eccentric-weighted gearboxs, electromagnetic drives, or direct mechanical linkages.

When the vibratory motor 38 imparts vibration to the drive assembly 23 in the direction of arrows 70, as seen in FIG. 3, the resonance of the motor 38 is such that it is in unison with the resonance of the torsion bars 32, mounted to the unfixed ends 35 of the torsion bars 32. Therefore, the entire drive assembly 23 is moved in the direction of arrows 70, as seen in FIG. 5, which in turn imparts that type of vibration to the entire separation component 12, where the affluent 60 is being introduced. In effect, the resonance between the motor 38 mounted on the drive assembly 23 in unison with the resonance of torsion bars 32 imparts maximum vibration to the separation component 12, and therefore, maximum separation between the fluid and solid portions of the affluent within the basket 50, through the use of the low energy vibratory motor 38. This provides a much improved, more efficient, and less expensive means to drive a vibratory centrifuge, rather than the direct drive which is found in most centrifuges of this type.

The following is a list of parts and materials suitable for use in the present invention.

PARTS LIST

| Part Number | Description |
|---|---|
| 10 | horizontal vibrating centrifuge |
| 12 | slurry separation component |
| 13 | circular wall |
| 14 | drive motor |
| 15 | door latch |
| 16 | motor base |

-continued

PARTS LIST

| Part Number | Description |
|---|---|
| 18 | motor mount |
| 20 | drive motor sheave |
| 22 | drive belt |
| 23 | drive assembly |
| 24 | drive unit sheave |
| 25 | discharge pipe |
| 27 | feed pipe |
| 28 | axle shaft |
| 29 | back wall |
| 30 | connecting rods |
| 31 | bearings |
| 32 | torsion bar |
| 33 | first fixed end |
| 34 | upper fixed spring clamp |
| 35 | second end |
| 36 | lower fixed spring clamp |
| 38 | vibratory motor |
| 41 | rod lower end |
| 45 | first portion |
| 47 | second portion |
| 49 | space |
| 50 | rotating screen |
| 51 | interior |
| 55 | solid portion |
| 60 | slurry |
| 61 | arrow |
| 62 | fluid portion |
| 63 | arrows |
| 67 | discharge chute |
| 68 | arrow |
| 70 | arrows |
| 80 | arrows |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. An improved horizontal vibratory centrifuge, comprising:

(a) a separation zone for receiving and separating solid and liquid components of a slurry;

(b) a drive motor for rotating a screen in the separation zone;

(c) a drive assembly between the drive motor and the separation zone;

(d) at least one vibratory motor for imparting vibration to the screen;

(e) a mounting assembly supporting the drive assembly;

(f) a plurality of torsion bars positioned on the mounting assembly for resonating in unison with the vibratory motor for imparting maximum vibratory movement to the screen for maximum separation of the solid and liquid components.

2. The system in claim 1, wherein the separation zone comprises a rotating screen having a porous wall for allowing fluid to flow therethrough, but where solid components are discharged elsewhere.

3. The system in claim 1, wherein the drive motor is linked to the drive assembly through a belt connection.

4. The system in claim 1, wherein the drive motor and the drive assembly are linked through a direct drive component, including mechanical, magnetic, hydraulic or electric means.

5. The system in claim 1, wherein there is provided one or more vibratory motors as required mounted on the drive assembly.

6. The system in claim 1, wherein the vibratory motor is a low energy electric eccentric-weight motor.

7. The system in claim 1, wherein the mounting assembly supporting the drive assembly comprises:

(a) a mounting platform for the drive assembly;

(b) a plurality of vertically disposed connecting rods moveably connected at a first end to the mounting platform and at a second end to a non-fixed end of the torsion bars;

(c) fixed mounting members for fixedly connecting to a second fixed end of each of the torsion bars.

8. The system in claim 7, further comprising bearings positioned at the connection between the connecting rods and the torsion bars.

9. The system in claim 7, wherein the vibrating action of the vibrating motor imparts movement to the connecting rods and torsion bars at a resonance in unison with the frequency of the vibrating motor.

10. The system in claim 1, wherein the maximum vibrating movement is achieved through the indirect link between the vibrating motor and the torsion bars and connecting rods of the mounting assembly.

11. A horizontal vibratory centrifuge system, comprising:

(a) a substantially closed separation zone for receiving and separating a slurry introduced into the zone into solid and liquid components;

(b) a drive motor for rotating a screen in the separation zone;

(c) a drive assembly positioned between the drive motor and the separation zone;

(d) means to provide input force for imparting vibration to the separation zone;

(e) a mounting assembly supporting the drive assembly, comprising at least a plurality of connecting rods moveably mounted at a first end to the mounting assembly;

(f) a plurality of torsion bars moveably connected to a second end of the connecting rods for resonating in unison with the drive motor for imparting maximum vibratory movement to the separation zone for maximum separation of the liquid and solid components.

12. The system in claim 11, wherein the separation zone includes an intake chute for introducing the slurry, and a screen for allowing fluid to flow therethrough and be discharged, but where solid components are discharged through a separate discharge area.

13. The system in claim 11, wherein the drive motor imparts rotation to the drive assembly through the use of a direct drive linkage.

14. The system in claim 11, wherein the means for providing input force to impart vibration to the separation zone comprises a pneumatic vibrator, eccentric-weighted gearbox, electromagnetic drive, or direct mechanical linkage.

15. The system in claim 11, wherein the means for providing input force to impart vibration to the separation zone comprises at least one low energy vibratory motor.

16. An improved horizontal vibratory centrifuge system, which includes a substantially closed separation zone for receiving and separating a slurry introduced into the zone into solid and fluid components; a drive motor for rotating a screen in the separation zone; and a drive assembly positioned between the drive motor and the separation zone; the improvement comprising:

(a) at least one low energy vibratory motor for imparting vibration to the screen;

(b) a mounting assembly supporting the drive assembly of the system, comprising at least a plurality of connecting rods subject to being moved by the vibrating motor;

(c) a plurality of torsion bars moveably attached to the connecting rods for resonating in unison with the vibratory motor for imparting maximum vibratory movement to a separation portion.

17. A method of achieving maximum vibration to a vibrating centrifuge with the use of a low energy vibrating motor, comprising the steps of:

(a) providing a separation zone for receiving and separating liquids from solids in the zone;

(b) rotating the screen with a drive motor;

(c) providing a drive assembly between the motor and the separation zone;

(d) mounting a single low energy vibrating motor to the drive assembly;

(e) mounting the drive assembly on a platform moveably connected to a plurality of torsion bars;

(f) powering the vibrating motor so that the vibrating motor vibrates in unison with the resonance of the torsion bars for imparting maximum vibration to the separation zone, and in turn achieves maximum separation between the liquid and solid components in the zone.

18. The method in claim 17, wherein the platform is connected to the torsion bars through a plurality of vertically positioned moveable connecting rods.

19. The method in claim 17, wherein there is included one or more vibratory motors.

20. The method in claim 17, wherein the method provides a low energy and efficient means to operate a vibratory centrifuge.

21. The method in claim 17, wherein the method comprises a means to continuously feed a slurry into the separation zone and continuously separate the slurry into the fluid and solid components.

22. The method in claim 17, wherein the use of bearings at the connections between the drive assembly and the platform and the connections between the platform connection rods to the torsion bars provide for the vibratory movement of the system through the single vibratory motor.

23. An improved horizontal vibratory centrifuge, comprising:

(a) a separation zone for receiving and separating the solid and liquid components of a slurry;

(b) a drive motor for rotating a screen in the separation zone;

(c) a drive assembly between the drive motor and the separation zone, mounted on torsion bars;

(d) at least one vibratory motor for imparting vibration to the screen;

(e) a mounting assembly supporting the drive assembly;

(f) free rotating axles positioned in the mounting assembly for resonating in unison with the vibratory motor for imparting the maximum vibratory movement to the screen for maximum separation of the solid and liquid components.

* * * * *